US006151861A

United States Patent [19]

Magri

[11] Patent Number: 6,151,861

[45] Date of Patent: Nov. 28, 2000

[54] APPARATUS FOR AUTOMATICALLY CONTINUOUSLY SUPPLYING RETRACTABLE SPOUTS FOR CARDBOARD BOXES AND THE LIKE

[76] Inventor: Giovanni Magri, Via de Rege Thesauro, 5, 25133, Brescia, Italy

[21] Appl. No.: 09/233,589

[22] Filed: Jan. 19, 1999

[51] Int. Cl.[7] ..... B65B 61/18

[52] U.S. Cl. ..... 53/168; 53/133.2; 53/133.4; 53/389.2; 413/22; 413/53; 493/87

[58] Field of Search ..... 413/22, 53; 493/87; 53/168, 133.2, 133.4, 389.2, 389.3

[56] References Cited

U.S. PATENT DOCUMENTS

| | | | |
|---|---|---|---|
| 1,842,455 | 6/1932 | Lord | 413/22 |
| 1,953,079 | 4/1934 | Hothersall | 413/53 |
| 2,061,575 | 11/1936 | Hothersall | 413/22 X |
| 2,216,733 | 10/1940 | Brucker | 413/53 |
| 2,300,099 | 10/1942 | Brucker | 493/87 X |
| 2,589,769 | 3/1952 | Brucker | 493/87 X |
| 2,654,332 | 10/1953 | Klausmann et al. | 413/53 X |
| 2,861,529 | 11/1958 | Klausmann | 413/53 |
| 2,892,430 | 6/1959 | Klausmann | 413/53 |
| 2,998,788 | 9/1961 | Back et al. | 413/53 |
| 3,025,813 | 3/1962 | Klausmann et al. | 413/53 |
| 3,325,071 | 6/1967 | Schmitz | 53/168 X |
| 3,381,645 | 5/1968 | Klausmann et al. | 413/53 |
| 3,385,248 | 5/1968 | Klausmann et al. | 413/53 |
| 3,523,512 | 8/1970 | Plaessman et al. | 413/53 |
| 3,690,223 | 9/1972 | Klausmann et al. | 493/87 |
| 3,793,970 | 2/1974 | Martinotti | 413/53 |
| 3,983,774 | 10/1976 | Seragnoli | 53/389.3 X |
| 4,072,117 | 2/1978 | Plaessmann | 413/53 |
| 4,806,055 | 2/1989 | Plaessmann | 413/22 X |
| 5,299,407 | 4/1994 | Schuttler et al. | 53/168 X |
| 5,665,045 | 9/1997 | Brucker | 493/87 |

*Primary Examiner*—Daniel B. Moon
*Attorney, Agent, or Firm*—Hedman, Gibson & Costigan, P.C.

[57] ABSTRACT

An apparatus for automatically and continuously supplying retractable spouts for cardboard boxes, which includes first and second storing devices for storing first and second spout webs and for continuously supplying said first and second spout webs from which spout elements are formed and cut and also includes feeding means for feeding said first spout web coming from said first storing device as well as end of web sensing means which actuate auxiliary feeding means for taking up the second spout web coming from the second storing device and also including a shaft supporting a first cam for operating the feeding means and the auxiliary feeding means and also including a second cam for operating a punch element for forming and shaping said spout elements, the feeding means including levers pivoted, at a respective middle portion thereof, to a support element and having an end portion thereof coupled to supports associated with the first cam wherein the web sensing means are arranged at said punch element.

4 Claims, 3 Drawing Sheets

APPARATUS FOR AUTOMATICALLY CONTINUOUSLY SUPPLYING RETRACTABLE SPOUTS FOR CARDBOARD BOXES AND THE LIKE

BACKGROUND OF THE INVENTION

The present invention relates to an apparatus for automatically continuously supplying retractable spouts for cardboard boxes and the like.

As is known, on rectangular cross-section cardboard boxes and packages, which are mainly used for food products and other products, are conventionally applied metal retractable elements, the so-called "spouts" which, in particular, are applied by forming and applying machines, cooperating with the product packaging lines, that is with the apparatus forming and filling-packaging the cardboard boxes.

Prior spout forming machines, however, present the problem that they require the operating system to be stopped in order to replace the spout magazine as the spouts have been exhausted.

This will involve an interruption of the production cycle, which will negatively affect the operating cost of the overall system.

SUMMARY OF THE INVENTION

Accordingly, the aim of the present invention is to overcome the above mentioned drawback, by providing an apparatus for automatically continuously supplying retractable spouts for cardboard boxes and the like, which allows to greatly reduce the operating time, i.e. which does not require that the apparatus be stopped, thereby allowing the spouts to be supplied continuously.

Within the scope of the above mentioned aim, a main object of the present invention is to provide such an apparatus which allows to automatically replace the spout web supplying magazine or vessel.

Another object of the present invention is to provide such an apparatus which allows to perform very safe and accurate operating steps, thereby providing a very reliable and safe operating apparatus.

Yet another object of the present invention is to provide such an apparatus which can be easily made starting from easily available elements and materials and which, moreover, is very competitive from a mere economic standpoint.

According to one aspect of the present invention, the above mentioned aim and objects, as well as yet other objects, which will become more apparent hereinafter, are achieved by an apparatus for automatically continuously supplying retractable spouts for cardboard boxes and the like, characterized in that said apparatus comprises at least two storing devices for continuously supplying spout webs from which spout elements must be formed and cut, feeding means for feeding a single spout web coming from a storing device as well as end of web sensing means adapted to actuate auxiliary feeding means for taking up the spout web coming from said other storing device being moreover provided.

BRIEF DESCRIPTION OF THE DRAWINGS

Further characteristics and advantages of the present invention will become more apparent hereinafter from the following detailed disclosure of a preferred, though not exclusive, embodiment of an apparatus for automatically continuously supplying retractable spouts for cardboard boxes and the like, which is illustrated, by way of an indicative, but not limitative example, in the accompanying drawings, where.

DESCRIPTION OF THE PREFERRED EMBODIMENT

Figure 1:
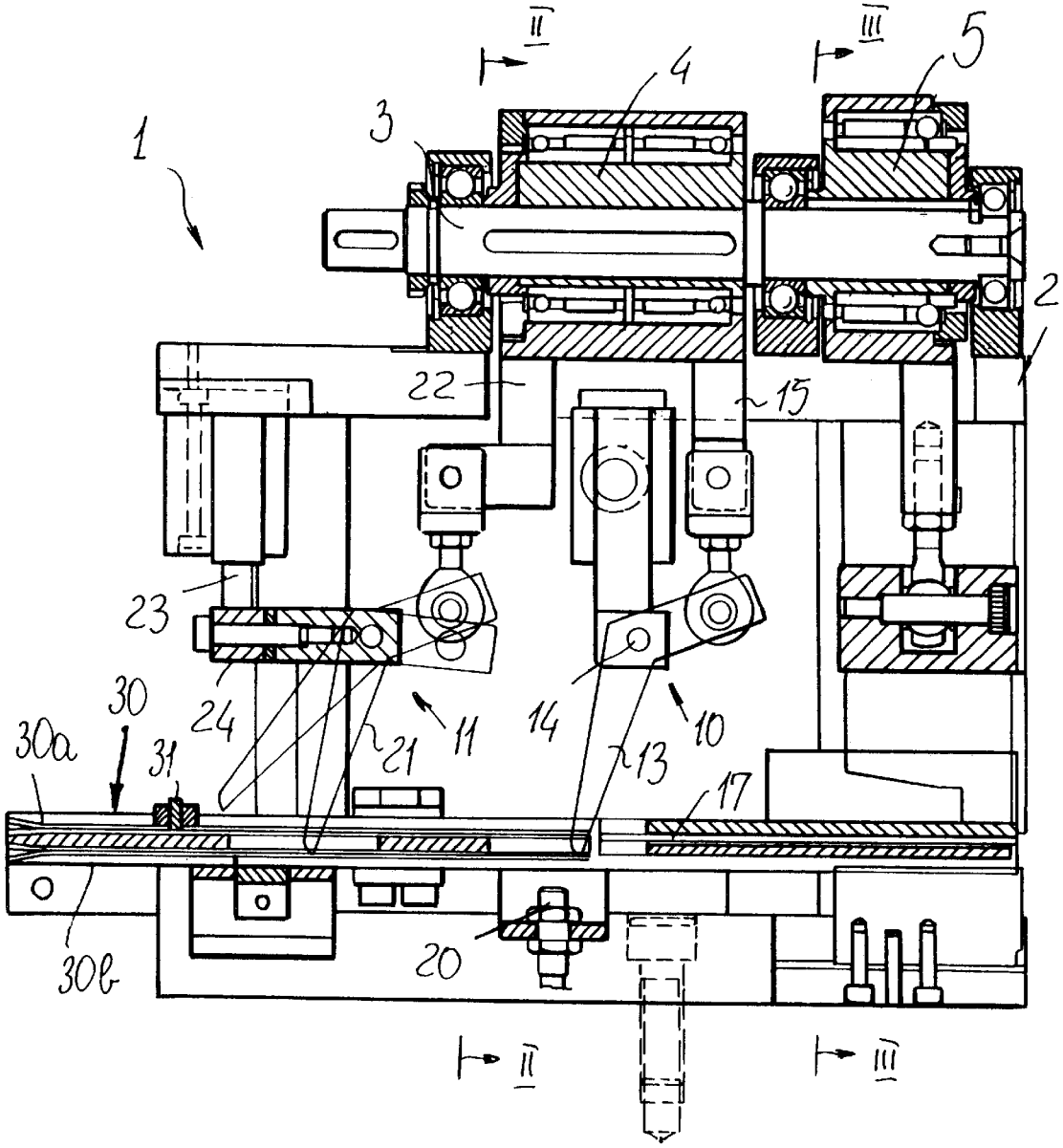
FIG. 1 is a schematic longitudinal cross-sectional view illustrating the apparatus according to the present invention.
Figure 2:
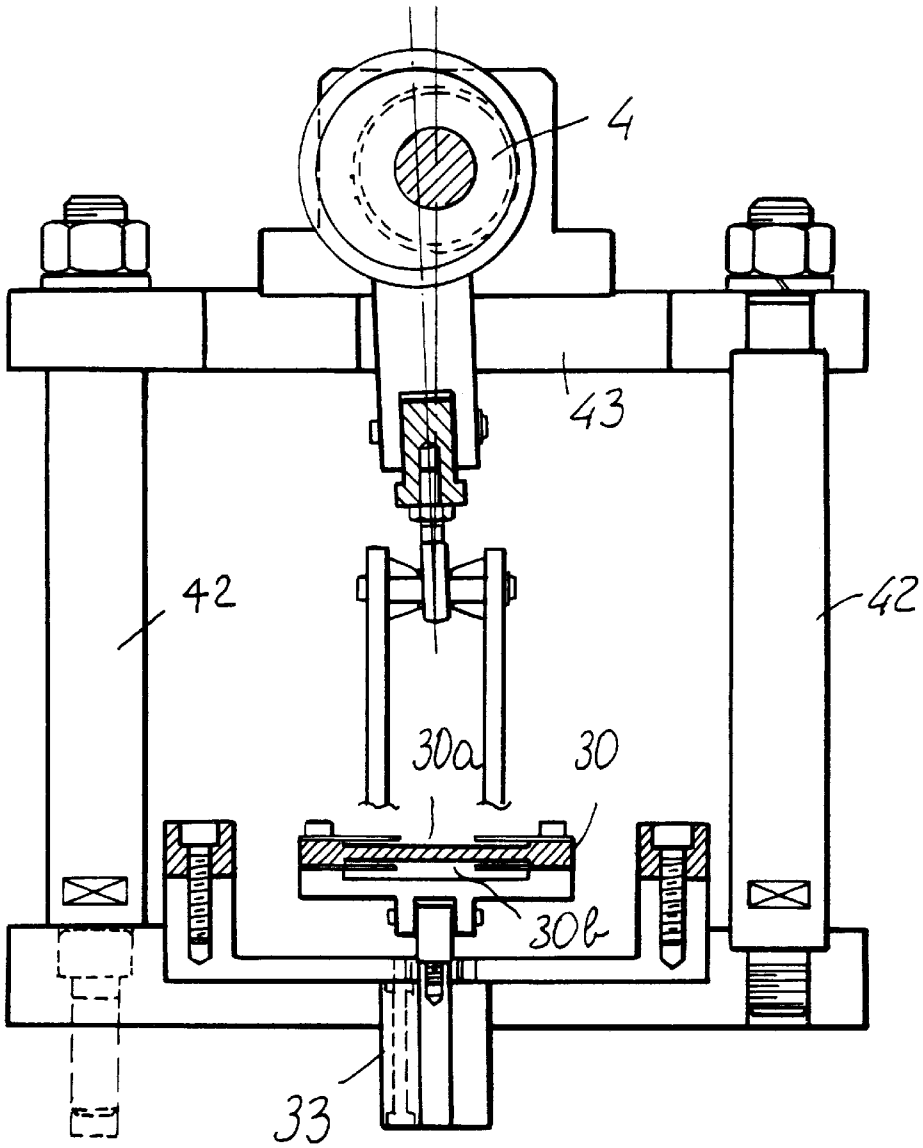
FIG. 2 is a further cross-sectional view substantially taken along the line II—II of FIG. 1.
Figure 3:
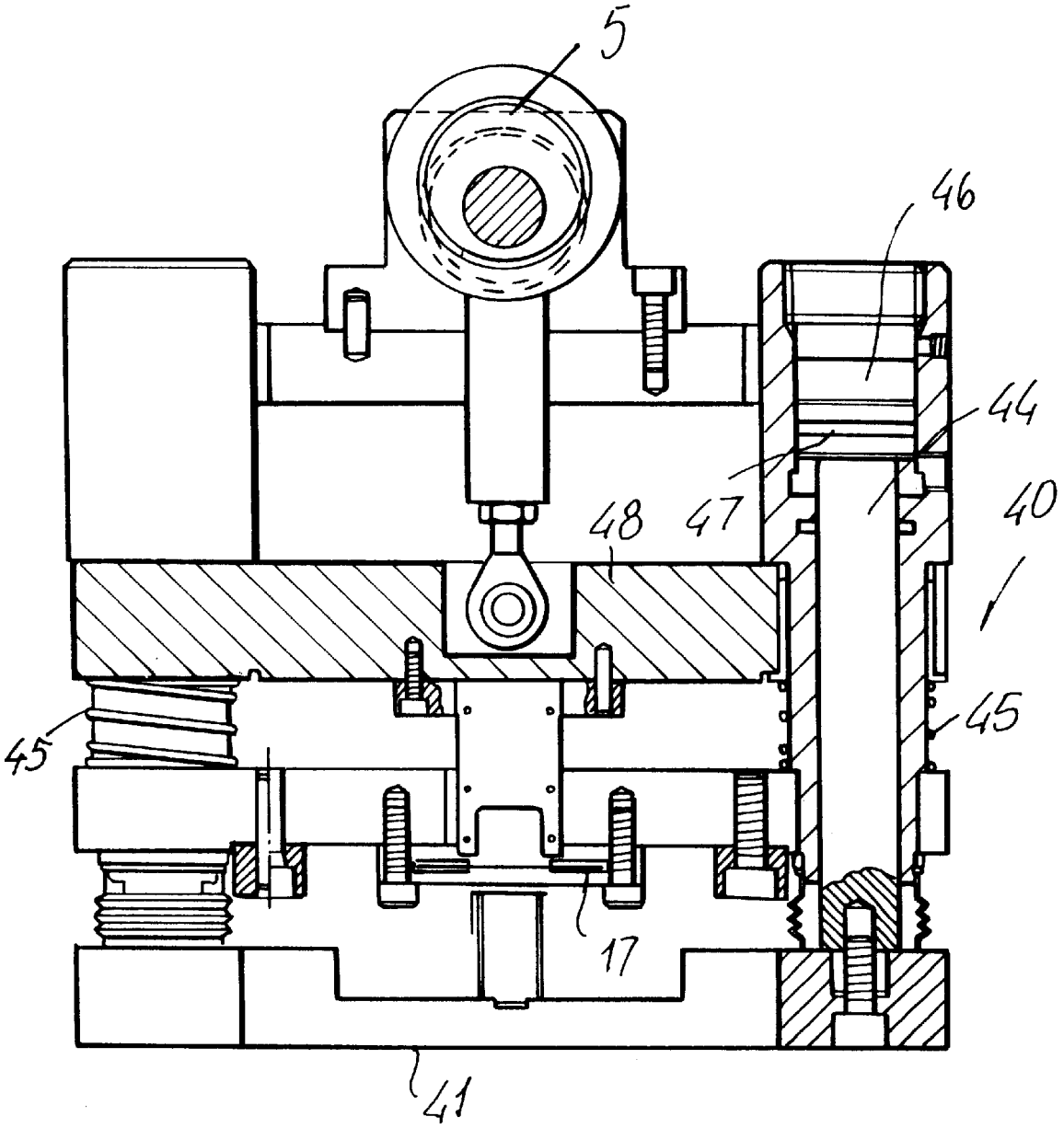
FIG. 3 is a further cross-sectional view taken along the section line III of FIG. 1.

With reference to the number references of the above mentioned figures, the apparatus for automatically continuously supplying retractable spouts for cardboard boxes and the like, according to the present invention, which has been generally indicated by the reference number 1, comprises a bearing framework 2, supporting a shaft 3 which is rotatively driven by a motor.

To said shaft 3 a first cam 4 and a second cam 5 are coupled, said first and second cams being arranged in a successive adjoining relationship.

More specifically, the first cam 4 operates feeding means, indicated by the reference number 10, for feeding a single spout web, as well as auxiliary feeding means which have been generally indicated by the reference number 11.

In particular, said apparatus can be coupled to two supplying magazines or storing devices for continuously supplying spout webs from which spout element must be formed and cut, and being individually caused to be fed.

The feeding means 10 comprise a lever 13, pivoted at 14, thereon operates a supporting element 15 coupled to the first cam so as to provide a reciprocating movement causing the web to be step advanced through a guide 17 for conveying said web to a punch element.

Upstream of said guide 17 an end of web sensor 20 is provided, actuating the auxiliary feeding means which comprise rear levers 21, also driven by the first cam 4 through a rear supporting element 22, as well as a cylinder 23 which, by its piston rod operates on support elements 24 to which are pivoted the rear levers 21.

Thus, the rear levers, which are operated in step by the front levers, under the same driving force coming from the shaft 3, will operate by cooperating with the front levers, i.e. by clamping the end portion of the other web coming from a further storing device or magazine held on said guides 30 and engaged by a pressing element 31.

Simultaneously with the operation of the first cylinder 23, the sensor 20 also actuates a second cylinder, indicated by the reference number 33, for orienting or controlling the top 30*a* and bottom 30*b* guides of the spout web, and which are formed in the guide 30 and hold an end portion of a new spout web to arrange the latter at the punch guide 17.

In operation, the guide 30*a* will receive the working spout web coming from the first storing device or magazine, whereas the guide 30*b* will receive the end portion of the web coming from the other storing device.

Thus, as the first storing device is exhausted, the web will be taken from the second storing device, by changing the guide.

In this connection it should be apparent that the rear levers 21 will entrain the end portion of the new web so as to bring it in engagement with the front levers 13, which will effectively entrain said web.

After some operating cycles, in which the end portion of the web is clamped by the front levers, the rear levers, after their operation, will be caused to return to a top standby position.

A timer will operate the cylinder 23 so as to cause the piston rod of said cylinder to return to a retracted position, with a consequent raising of the rear levers 21 which will be disengaged from the web.

At the region where the punch 40 is arranged, for operation by the second cam 5, a bottom plate 41 is located, said bottom plate supporting four fixed pillars 42 which, in turn, support a top plate 43, to which the overall driving assembly is connected.

The front pillars or columns 44 will operate to control the reciprocating displacement of the punch assembly, which will stop the spout elements.

With the operation of the two springs 45 which are also provided to operate as spout pressing elements, is associated the operation of two pneumatic cylinders 46 provided at the front pillars 44 and in which the enlarged portions 47 will operate as piston elements for aiding the movable plate 48 to recover its home position for each operating cycle.

In particular, the subject apparatus has been specifically designed to operate with a their broad range of spout size, independently from the type and shapes thereof, since for fitting the apparatus to different spout elements it will be merely sufficient to change the guides and spacer elements therefor, as well as their supports, so as to provide a proper adjustment of the positions of the articulating points of the front and rear levers, depending on a changing of the spout pitch.

From the above disclosure it should be accordingly apparent that the invention fully achieves the intended aim and objects.

In particular, it is to be pointed out that an apparatus has been provided for automatically and continuously supplying retractable spout elements for cardboard boxes and the like, the operation of which is actually continuous.

The invention, as disclosed, is susceptible to several modifications and variations, all of which will come within the inventive idea scope.

Moreover, all of the details can be replaced by other technically equivalent elements.

In practicing the invention, the used materials, provided that they are compatible to the intended application, as well as the contingent size and shaped, can be any, depending on requirements.

What is claimed is:

1. An apparatus for automatically and continuously supplying retractable spouts for cardboard boxes, wherein said apparatus comprises first and second storing devices for storing first and second spout webs and for continuously supplying said first and second spout webs from which spout elements are formed and cut, feeding means for feeding said first spout web coming from said first storing device, and end of web sensing means actuating auxiliary feeding means for taking up said second spout web coming from said second storing device, a shaft supporting a first cam for operating said feeding means and said auxiliary feeding means, and a second cam for operating a punch element for forming and shaping said spout elements, said feeding means comprising front levers pivoted, at a respective middle portion thereof, to a support element and having an end portion thereof coupled to supports associated with said first cam, and wherein said web sensing means are arranged at said punch element.

2. An apparatus, according to claim 1, wherein said auxiliary feeding means comprise rear levers supported by a support coupled to a cylinder controlled by said web sensing means, said rear levers being operatively coupled to said first cam.

3. An apparatus, according to claim 2, wherein said apparatus comprises a timer for deactuating said rear levers after a set number of operating cycles.

4. An apparatus, according to claim 1, wherein said apparatus comprises a guide element provided with a bottom tract element and a top track element, for supplying said first and second webs coming from said two storing devices, said bottom and top track elements being coupled to a cylinder for selectively arranging said guide element at said punch element.

* * * * *